US012298032B2

(12) United States Patent
Hwang et al.

(10) Patent No.: US 12,298,032 B2
(45) Date of Patent: May 13, 2025

(54) AIR CONDITIONING SYSTEM

(71) Applicant: KYUNGDONG NAVIEN CO., LTD., Pyeongtaek-si (KR)

(72) Inventors: In Soo Hwang, Seoul (KR); Dong Keun Lee, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 253 days.

(21) Appl. No.: 17/974,295

(22) Filed: Oct. 26, 2022

(65) Prior Publication Data

US 2023/0135260 A1 May 4, 2023

(30) Foreign Application Priority Data

Nov. 3, 2021 (KR) ..... 10-2021-0150026

(51) Int. Cl.
*F24F 3/147* (2006.01)
*F24F 3/14* (2006.01)
(Continued)

(52) U.S. Cl.
CPC ..... *F24F 3/147* (2013.01); *F24F 13/30* (2013.01); *F24F 2003/1446* (2013.01);
(Continued)

(58) Field of Classification Search
CPC .... F24F 3/147; F24F 3/1423; F24F 2003/144; F24F 2003/1446; F24F 2003/1464;
(Continued)

(56) References Cited

U.S. PATENT DOCUMENTS

2011/0308265 A1* 12/2011 Phannavong ..... F24F 11/62 62/160
2023/0213227 A1* 7/2023 Lee ..... F24F 13/20 62/81

FOREIGN PATENT DOCUMENTS

JP 2003269822 A 9/2003
KR 20050065259 A 6/2005
(Continued)

OTHER PUBLICATIONS

Korean Office Action for corresponding Application No. 10-2021-0150026, dated Nov. 19, 2024, 6 pages.

*Primary Examiner* — Miguel A Diaz
(74) *Attorney, Agent, or Firm* — Dority & Manning, P.A.

(57) ABSTRACT

The present disclosure provides that the air conditioning system includes a compressor, a condenser, an expansion valve, and an evaporator through which a refrigerant circulates; an indoor unit in which the evaporator is disposed; an outdoor unit; and a dehumidification unit connected to the indoor unit, in which the dehumidification unit includes a regeneration channel including a first outdoor air inlet and an outdoor outlet, a dehumidification channel including an indoor air inlet or a second outdoor air inlet and an indoor supply, a dehumidification rotor disposed between the regeneration channel and the dehumidification channel, and a heat exchange unit disposed between the dehumidification rotor and the first outdoor air inlet in the regeneration channel to heat passing air, and the indoor unit is configured such that the air supplied from the indoor supply unit passes through the evaporator and then is supplied to a room.

10 Claims, 13 Drawing Sheets

(51) Int. Cl.
*F24F 13/30* (2006.01)
*F24F 11/00* (2018.01)
*F24F 110/20* (2018.01)

(52) U.S. Cl.
CPC ..... *F24F 2003/1464* (2013.01); *F24F 2011/0002* (2013.01); *F24F 2110/20* (2018.01)

(58) Field of Classification Search
CPC ..... F24F 2110/20; F24F 2011/0002; F24F 2203/10; F24F 2203/1016; F24F 2203/1032; F24F 2203/104
See application file for complete search history.

(56) References Cited

FOREIGN PATENT DOCUMENTS

| | | | |
|---|---|---|---|
| KR | 10-2007-0064077 | | 6/2007 |
| KR | 20160088846 | A | 7/2016 |
| KR | 20210085401 | A | 7/2021 |

* cited by examiner

AIR CONDITIONING SYSTEM

CROSS-REFERENCE TO RELATED APPLICATION(S)

This application claims benefit of priority to Korean Patent Application No. 10-2021-0150026 filed on Nov. 3, 2021 in the Korean Intellectual Property Office, the disclosure of which is incorporated herein by reference in its entirety.

BACKGROUND

1. Field

The present disclosure relates to an air conditioning system, and to an air conditioning system capable of dehumidifying and cooling through a dehumidification rotor.

2. Description of Related Art

In general, an air conditioner drives a cooling cycle according to a user request, and cools a room in hot weather by an operation of the cooling cycle. Such an air conditioner may control indoor humidity, and may perform a dehumidification operation to adjust indoor air to a pleasant dry state.

FIG. 1 illustrates a schematic diagram of a cooling cycle of a general air conditioner, and FIG. 2 illustrates a P-H diagram in the cooling cycle.

The cooling cycle 100 of the air conditioner includes a compressor 114 disposed in an outdoor unit 101 and which compresses a refrigerant, a condenser 111 condensing the compressed refrigerant, an expansion valve 112 disposed in an indoor unit 102 and expanding the condensed refrigerant, and an evaporator 113 through which the refrigerant is evaporated.

Although not illustrated in the outdoor unit 101, a fan is installed to form an air flow A1, and the air flow A1 is an air flow in which outdoor air flows into the outdoor unit 101, cools the condenser 111, and is then discharged back to the outside. The fan is also installed in the indoor unit 102 to form an internal circulation flow A10. The internal circulation flow A10 is an air flow in which indoor air flows into the indoor unit 102, is cooled while passing through the evaporator 113, and then is supplied back into a room.

When the air conditioner performs a cooling operation, a dew condensation phenomenon occurs on a surface of the evaporator 113, the indoor heat exchanger, due to a temperature difference between the hot temperature of the room and the cold temperature of an indoor heat exchanger, and this phenomenon is used for dehumidification. Such dehumidification has limitations, in that cooling is inevitable, and it is difficult to lower the humidity as much as desired.

Meanwhile, as illustrated in the P-H diagram of FIG. 2, when compression is performed in the compressor 114, the temperature of the refrigerant rises to a considerably high temperature, for example, about 90° C. Since this thermal energy has to be lowered to a sufficiently low temperature by exchanging heat with air through the condenser 111, the heat exchange ability of the condenser 111 affects the performance of the air conditioner and a large load is applied to the condenser 111.

(Patent Document 1) KR 10-2007-0064077 A

SUMMARY

An aspect of the present disclosure may provide an air conditioning system that facilitates humidity control and cooling control of indoor air.

The present disclosure provides the following air conditioning system to achieve the above object.

According to an aspect of the present disclosure, an air conditioning system may include: a compressor, a condenser, an expansion valve, and an evaporator through which a refrigerant circulates; an indoor unit in which the evaporator is disposed; an outdoor unit in which the condenser is disposed; and a dehumidification unit connected to the indoor unit, in which the dehumidification unit includes a regeneration channel including a first outdoor air inlet and an outdoor outlet, a dehumidification channel including an indoor air inlet or a second outdoor air inlet and an indoor supply, a dehumidification rotor disposed between the regeneration channel and the dehumidification channel, and a heat exchange unit disposed between the dehumidification rotor and the first outdoor air inlet in the regeneration channel to heat passing air, and the indoor unit is configured such that the air supplied from the indoor supply unit passes through the evaporator and then is supplied to a room.

The heat exchange unit may be configured to exchange heat between the refrigerant between the condenser and the compressor and the air introduced from the first outdoor air inlet.

According to another aspect of the present disclosure, an air conditioning system may include: a compressor, a condenser, an expansion valve, and an evaporator through which a refrigerant circulates; an indoor unit in which the evaporator is disposed; an outdoor unit in which the condenser is disposed; and a dehumidification unit connected to the room, in which the dehumidification unit includes a regeneration channel including a first outdoor air inlet and an outdoor outlet, a dehumidification channel including an indoor air inlet or a second outdoor air inlet and an indoor supply, a dehumidification rotor disposed between the regeneration channel and the regeneration channel, and a heat exchange unit disposed between the dehumidification rotor and the first outdoor air inlet in the regeneration channel to heat passing air, and the heat exchange unit is configured to exchange heat between the refrigerant between the condenser and the compressor and the air introduced from the first outdoor air inlet.

The condenser may be an evaporative condenser, and the evaporative condenser may include: a condensing module including a fluid passage; a water injection module spraying water passing through the condensing module from an upper portion of the condensing module; and a blowing module disposed on one side of the condensing module to provide air passing through the condensing module, in which, in the condensing module, a plurality of header columns including a first header extending in a first direction and having a channel formed therein, a second header extending in the first direction and having a channel formed therein, and a plurality of connection tubes extending in a second direction between the first header and the second header and connecting the channels of the first header and the second header may be stacked in a third direction, the first to third directions may be different from each other, and the condensing module, the water injection module, and the blowing module may be disposed such that the water sprayed by the water injection module and the air provided by the blowing module pass between the connection tubes of the condensing module.

The dehumidification rotor may be disposed in the outdoor unit, in the dehumidification channel, the indoor air inlet and the indoor supply unit may be connected through a duct, and a valve for adjusting only air of either the indoor air inlet or the second outdoor air inlet to flow into the dehumidification rotor may be disposed before the dehumidification rotor on the dehumidification channel.

BRIEF DESCRIPTION OF DRAWINGS

The above and other aspects, features, and advantages of the present disclosure will be more clearly understood from the following detailed description taken in conjunction with the accompanying drawings, in which:

FIGS. 6 to 8 are schematic diagrams of an air conditioning system according to a fourth embodiment of the present disclosure, in which FIG. 6 is a schematic diagram in which indoor dehumidification and cooling is performed, FIG. 7 is a schematic diagram in which ventilation and dehumidification and cooling are performed, and FIG. 8 is a schematic diagram in which dehumidification is performed in some spaces and cooling is performed in some spaces;

DETAILED DESCRIPTION

Figure 1:
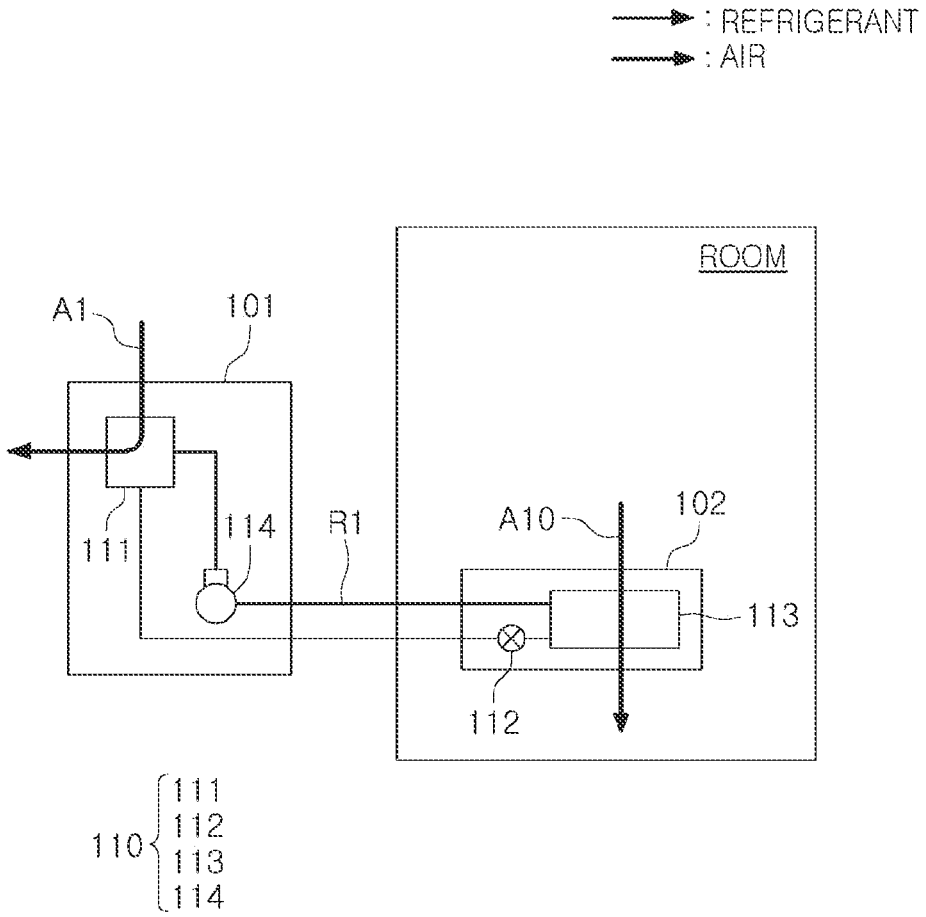
FIG. 1 is a schematic diagram of a cooling cycle of a conventional air conditioner.

Hereinafter, embodiments will be described in detail with reference to the accompanying drawings so that they may be easily practiced by those skilled in the art to which the present disclosure pertains. However, in describing exemplary embodiments of the present disclosure, detailed descriptions of well-known functions or constructions will be omitted so as not to obscure the description of the present disclosure with unnecessary detail. In addition, like or similar reference numerals denote parts performing similar functions and actions throughout the drawings. In addition, in this specification, terms such as "on," "upper portion," "upper surface," "under" "lower portion," "lower surface," "side," etc., are based on the drawings, and in reality, elements or components may vary depending on a direction in which these elements or components are disposed.

A case in which any one part is connected with the other part includes a case in which the parts are directly connected with each other and a case in which the parts are indirectly connected with each other with other elements interposed therebetween. In addition, a phrase 'including any component' will be understood to imply the inclusion of other components rather than the exclusion of other component, unless explicitly described otherwise.

The present disclosure provides an air conditioning system in which dehumidification and cooling may be performed at the same time. The dehumidification is performed through a dehumidification rotor in a dehumidification unit, the cooling is performed by a cooling cycle that is arranged in an indoor unit and an outdoor unit and includes condensation, expansion, evaporation, and compression, and the dehumidified air is directly or indirectly supplied to the evaporator of the cooling cycle, so the desired humidity and the desired air temperature may be provided to a room to satisfy a user. The dehumidification unit may be disposed together with the outdoor unit or the indoor unit, or may be disposed in a space separate from the indoor unit in which the evaporator is disposed. In this case, the air flow may be guided by a duct.

In the present disclosure, the air flow is performed by a fan, and the air flow is formed by a fan (not illustrated) except for natural air flow. In addition, a valve for determining branching or confluence may be installed at a branch point or a confluence point, and a blocking of confluence or a determination in a branching direction may be determined by the valve.

Figure 3:
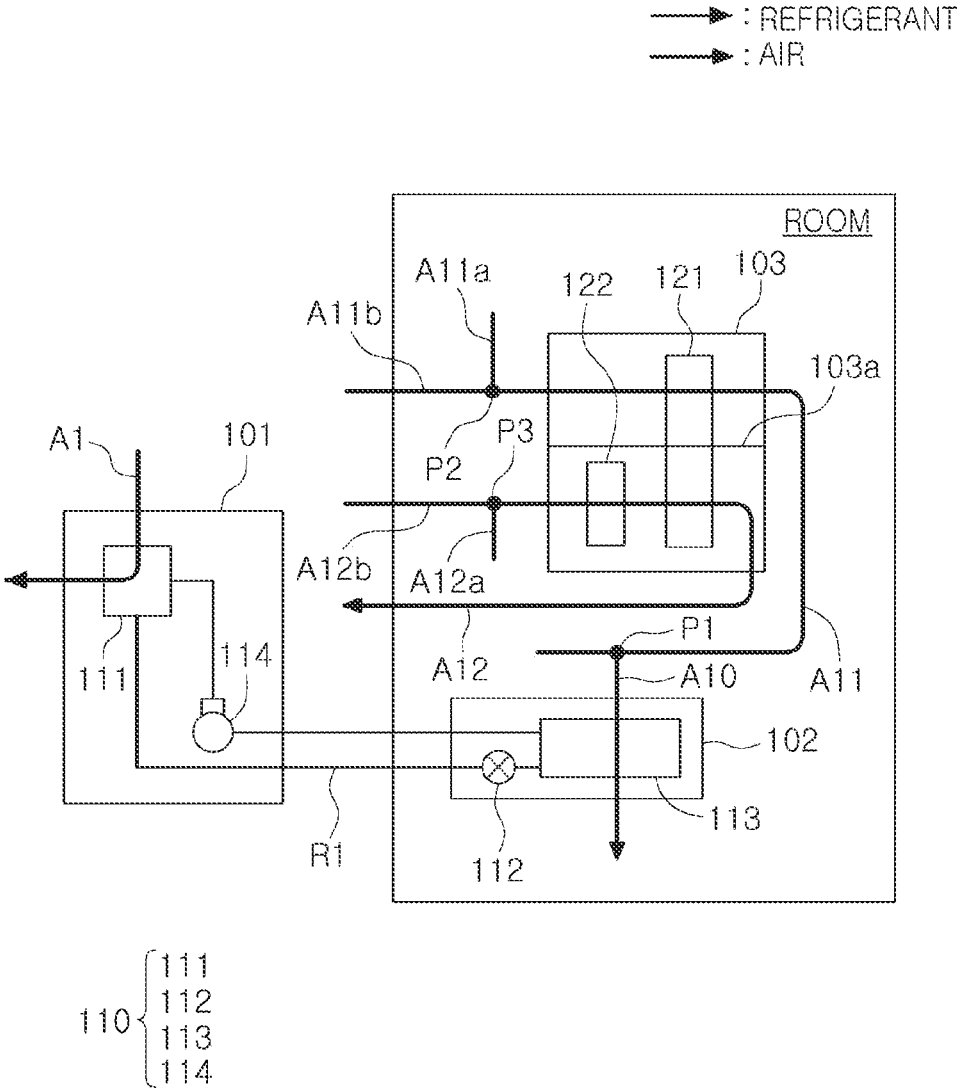
FIG. 3 is a schematic diagram of an air conditioning system according to a first embodiment of the present disclosure.

FIG. 3 illustrates a schematic diagram of a first embodiment of the present disclosure. The air conditioning system of the first embodiment of the present disclosure includes an outdoor unit 101, an indoor unit 102, and a dehumidification unit 103. In this embodiment, the indoor unit 102 and the dehumidification unit 103 are equally disposed indoors, but the dehumidification unit 103 may be disposed outdoors as described above. However, even if the dehumidification unit 103 is disposed outdoors, a channel direction does not change. In the present disclosure, the dehumidification unit 103 is configured to include a dehumidification rotor 121 to dehumidify the air in the dehumidification channel, and may be configured as a separate mechanism physically separated from the indoor unit 102 or the outdoor unit 101, but may be partially configured inside the indoor unit 102 or the outdoor unit 101.

The air conditioning system of the first embodiment of the present disclosure includes a cooling cycle 110 including a condenser 111 condensing the compressed refrigerant, an expansion valve 112 expanding the refrigerant passing through the condenser 111, and an evaporator 113 evaporating the refrigerant passing through the expansion valve 112, and a compressor 114 compressing the refrigerant passing through the evaporator 113, and a refrigerant channel R1 is configured to circulate the refrigerant in the cooling cycle 110. The condenser 111 and the compressor 114 are disposed in the outdoor unit 101, and the expansion valve 112 and the evaporator 113 are disposed in the indoor unit 102, but the compressor 114 and the expansion valve 112 may be located in different positions.

An air channel A1 for cooling the refrigerant of the condenser 111 passes through the condenser 111, and the air channel A1 supplies outdoor air to the condenser 111 to exchange heat with the condenser 111 and then discharge heat back to the outside.

A circulation channel A10 for exchanging heat with the refrigerant of the evaporator 113 passes through the evaporator 113. Indoor air is supplied to the circulation channel A10. If necessary, the dehumidified air of the dehumidification channel A11 of the dehumidification unit 103 may be supplied together with the indoor air. A confluence point P1 that joins the dehumidification channel A11 before being introduced into the evaporator 113 in the circulation channel A10 is located.

The dehumidification unit 103 includes a regeneration channel A12 including a first outdoor air inlet and an outdoor outlet, a dehumidification channel A11 including an indoor air inlet or a second outdoor air inlet and an indoor supply unit, a dehumidification rotor 121 that is disposed between the regeneration channel A12 and the dehumidification channel A11, and a heat exchange unit 122 that is disposed between the dehumidification rotor 121 and the first outdoor air inlet in the regeneration channel A12 and heats passing air, in which the dehumidification channel A11 and the regeneration channel A12 are partitioned by an inner wall 103*a* within the dehumidification unit 103.

The dehumidification channel A11 includes an indoor air inflow passage A11*a* that is connected to an indoor air inlet to dehumidify and circulate indoor air, and an outdoor air inflow passage A11*b* that is connected to the second outdoor air inlet for dehumidifying and supplying outdoor air to a room, in which the indoor air inflow passage A11*a* and the outdoor air inflow passage A11*b* join a confluence point P2, pass through the dehumidification rotor 121, and then are supplied to the confluence point P1.

The regeneration channel A12 is a channel for regenerating the dehumidification rotor 121 through outdoor air, and when ventilation is required, the dehumidification rotor 121 may be regenerated through indoor air discharged to the outside. The regeneration channel A12 includes an indoor air inflow passage A12*a* that is connected to the indoor air inlet for ventilation and an outdoor air inflow passage A12*b* that is connected to the first outdoor air inlet for regeneration with outdoor air. The indoor air inflow passage A12*a* and the outdoor air inflow passage A12*b* join a confluence point P3 and are supplied to the heat exchange unit 122.

As the dehumidification rotor 121, the conventional dehumidification rotor 121 may be used. That is, the disk-shaped/cylindrical structure disposed between the regeneration channel A12 and the dehumidification channel A11 rotates through a motor. The dehumidification rotor 121 has a honeycomb-shaped porous structure, and may be coated with a dehumidifying agent, and various types of dehumidification rotors may be used.

The heat exchange unit 122 may be configured to heat indoor or outdoor air introduced into the regeneration channel A12 to regenerate the dehumidification rotor 121 using heating or an external heat source, and when the air in the regeneration channel A12, such as a heating coil heated by electricity or a heat exchanger using hot water, may be heated, various types of heat exchange units may be applied.

In this embodiment, the air conditioning system includes an indoor unit 101 and an outdoor unit 102 that perform cooling, and further includes a dehumidification unit 103. Accordingly, it is possible not only to adjust humidity/temperature of the indoor air, but also to adjust the humidity/temperature of the indoor air while performing ventilation.

The air conditioning system may perform a ventilation-dehumidification-cooling mode performing cooling and dehumidification at the same time and a ventilation-dehumidification mode that dehumidifies and supplies outdoor air without cooling.

In addition, the dehumidification unit 103 may serve as a ventilation device when there is no dehumidification operation, so it is possible to perform the ventilation mode. Only the ventilation may be performed while the dehumidification rotor 121 is not operated, and it is also possible to perform a ventilation-cooling mode in interlocking with the indoor unit 102. On the other hand, an indoor dehumidification mode in which only the dehumidification of the indoor air is performed by operating the dehumidification rotor 121 without the operation of the indoor unit 102 and circulating the indoor air with the dehumidification rotor 121 is also possible.

In the case of the ventilation mode, outdoor air is introduced into a room through the outdoor air inflow passage A11*b*, and the indoor air is discharged to the outside through the indoor air inflow passage A12*a*. The ventilation-cooling mode operates in the same way as the ventilation, but the cooling cycle 110 operates so that outdoor air that has passed through the dehumidification unit 103 joins the circulation channel A10 and is cooled while passing through the evaporator 113 and supplied to a room.

In the case of the indoor dehumidification mode, indoor air is supplied to the dehumidification rotor 121 through the indoor air inflow passage A11*a* and then passes through the dehumidification rotor 121 to supply the dehumidified air back to a room and regenerate the dehumidification rotor 121 with outdoor air through the outdoor air inflow passage A12*b*.

Meanwhile, only the cooling cycle 110 operates without the operation of the dehumidification unit 103 to perform only a cooling role in which indoor air is introduced into the circulation channel A100 to be cooled.

When the dehumidification unit 103 operates, the dehumidified air may be supplied to the indoor unit 101, which reduces the occurrence of dew condensation in the evaporator 113 of the indoor unit 101. In addition, since the dehumidified air is provided to the evaporator 113, it is possible to quickly remove the dew condensation during the drying operation of the evaporator 113 to suppress the growth of mold or bacteria due to the dew condensation occurring in the evaporator 113, thereby providing a user with a pleasant environment. Compared to an air conditioner having a drying function, a separate operation for drying may not be required or may be shorter, and an immediate response may be provided to a user, thereby providing user satisfaction.

Figure 4:
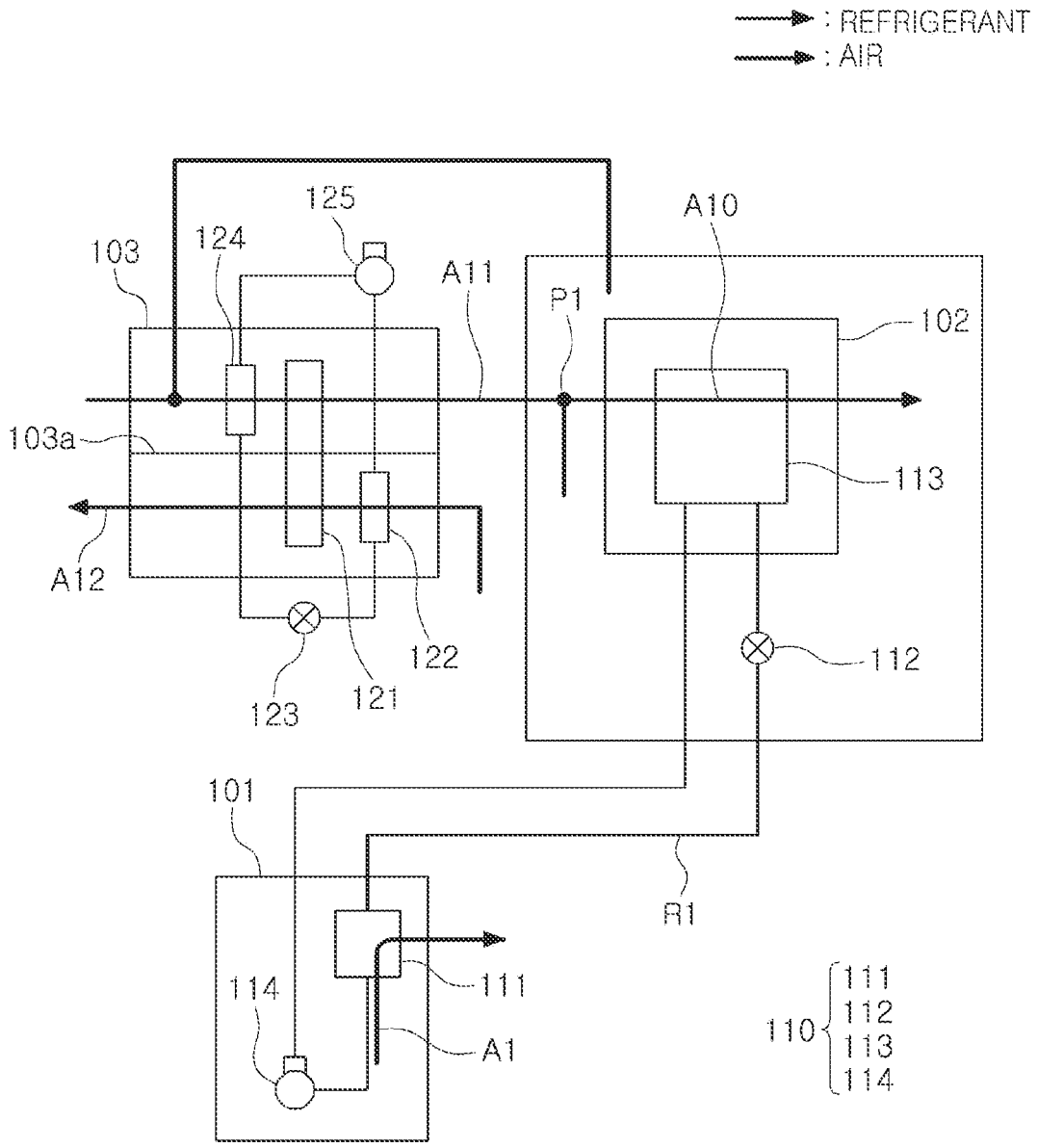
FIG. 4 is a schematic diagram of an air conditioning system according to a second embodiment of the present disclosure.

FIG. 4 illustrates a schematic diagram of a second embodiment of the present disclosure. The air conditioning system of the second embodiment of the present disclosure includes an outdoor unit 101, an indoor unit 102, and a dehumidification unit 103. In this embodiment, the dehumidification unit 103 is disposed outdoors.

The air conditioning system of the second embodiment of the present disclosure includes a cooling cycle 110 including a condenser 111 condensing the compressed refrigerant, an expansion valve 112 expanding the refrigerant passing through the condenser 111, and an evaporator 113 evaporating the refrigerant passing through the expansion valve 112, and a compressor 114 compressing the refrigerant passing through the evaporator 113, and in the cooling cycle 110, a refrigerant channel R1 is circulated. An air channel A1 for cooling the refrigerant of the condenser 111 passes through the condenser 111, and the air channel A1 supplies outdoor air to the condenser 111 to exchange heat with the condenser 111 and then discharge heat back to the outside.

A circulation channel A10 for exchanging heat with the refrigerant of the evaporator 113 passes through the evaporator 113. Indoor air is supplied to the circulation channel A10. If necessary, the dehumidified air of the dehumidification channel A11 of the dehumidification unit 103 may be supplied together with the indoor air. A confluence point P1 that joins the dehumidification channel A11 before being introduced into the evaporator 113 in the circulation channel A10 is located.

The dehumidification unit 103 includes a regeneration channel A12 including a first outdoor air inlet and an outdoor outlet, a dehumidification channel A11 including a second outdoor air inlet and an indoor supply unit, a dehumidification rotor 121 that is disposed between the regeneration channel A12 and the dehumidification channel A11, and the dehumidification rotor 121 in the regeneration channel A12. In addition, the dehumidification unit 103 includes heat exchange units 122 and 124 respectively disposed between the dehumidification channel A11 and the regeneration channel A11, and an expansion valve 123 and a compressor 125 disposed between the heat exchange units 122 and 124. That is, the dehumidification unit 103 includes a heat pump cycle including the heat exchange unit 122 heating outdoor air supplied to the dehumidification rotor 121 on the regeneration channel and the heat exchange unit 124 cooling outdoor air supplied to the dehumidification rotor 121 on the dehumidification channel. In this heat pump cycle, the roles of the heat exchange units 122 and 124 may be switched as needed. In the dehumidification unit 103, the dehumidification channel A11 and the regeneration channel A12 are partitioned by an inner wall 103*a*. The dehumidification channel A11 may be connected to the confluence point P1, and may be connected to the circulation channel A10, and the dehumidified air may be supplied to the evaporator 113 alone or in combination with the indoor air.

Although the dehumidification unit 103 has been briefly described in this embodiment, the dehumidification unit 103 has a structure in which the indoor inlet of the dehumidification unit 103 is connected to the circulation channel A10 as in Korean Patent No. 10-2216718.

In this embodiment, the air conditioning system includes the indoor unit 101 and the outdoor unit 102 that perform cooling, and further includes the dehumidification unit 103. Accordingly, it is possible not only to adjust humidity/temperature of the indoor air, but also to adjust the humidity/temperature of the indoor air while performing ventilation.

The air conditioning system may perform a ventilation-dehumidification-cooling mode performing cooling and dehumidification at the same time and a ventilation-dehumidification mode that dehumidifies and supplies outdoor air without cooling.

In addition, the dehumidification unit 103 may perform a ventilation mode when there is no dehumidification operation, and it is also possible to perform a ventilation-cooling mode in interlocking with the indoor unit 102. On the other hand, it is possible to perform an indoor dehumidification mode in which only the dehumidification of the indoor air is performed by circulating the indoor air to the dehumidification unit 103 while operating the dehumidification rotor 121 without the operation of the indoor unit 102.

In the case of the ventilation mode, outdoor air is introduced into a room through the outdoor air inflow passage without the operation of the dehumidification rotor 121, and exhausted through an exhaust passage (e.g., duct 106 in FIG. 6) (not illustrated). The ventilation-cooling mode operates in the same way as the ventilation, but the cooling cycle 110 operates so that outdoor air that has passed through the dehumidification unit 103 joins the circulation channel A10 and is cooled while passing through the evaporator 113 and supplied to a room.

In the case of the indoor dehumidification mode, indoor air is supplied to the dehumidification rotor 121 through the indoor air inflow passage and then passes through the dehumidification rotor 121 to supply the dehumidified air back to a room and regenerate the dehumidification rotor 121 through the regeneration channel A12.

Figure 5:
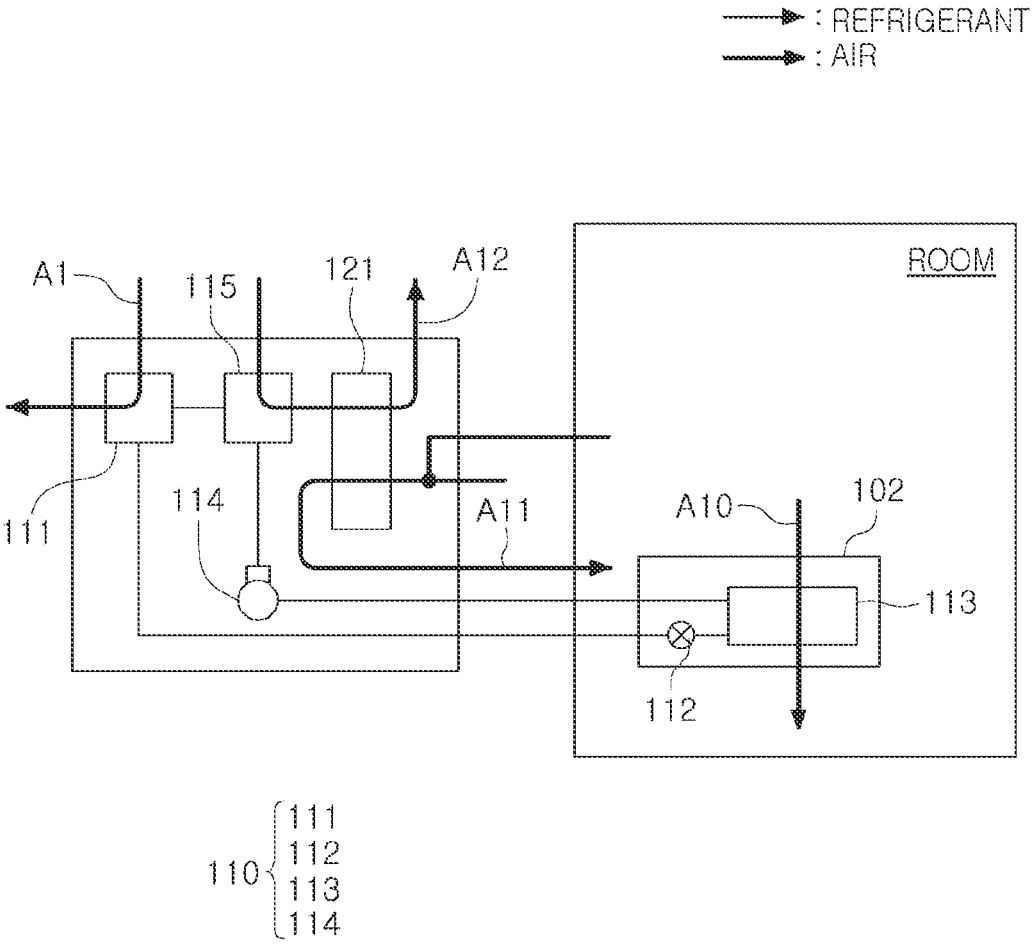
FIG. 5 is a schematic diagram of an air conditioning system according to a third embodiment of the present disclosure.

FIG. 5 illustrates a schematic diagram of an air conditioning system according to a third embodiment of the present disclosure. The air conditioning system of the third embodiment of the present disclosure includes a cooling cycle 110 in which the compressed refrigerant circulates in the same manner as in the first and second embodiments, and in the cooling cycle 110, further includes a heat exchange unit 115 between a compressor 114 and a condenser 111. In the third embodiment, the dehumidification unit 103 for dehumidifying indoor air is not provided separately from the outdoor unit 101 and the outdoor unit 102, and the dehumidification rotor 121 is disposed inside the outdoor unit 101.

Figure 2:
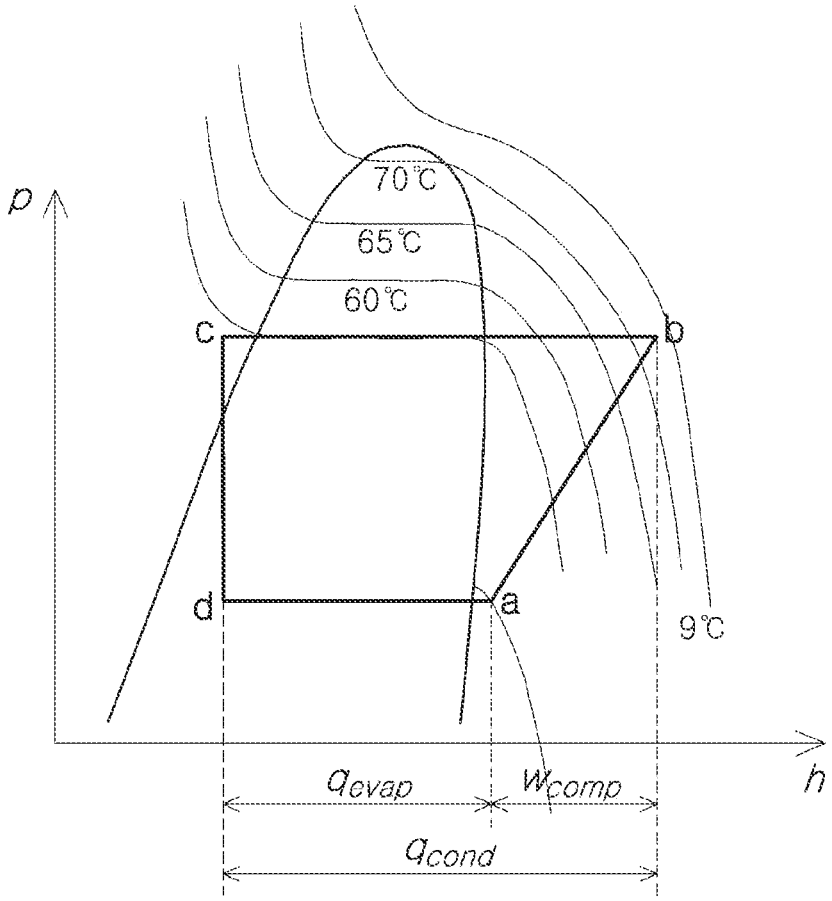
FIG. 2 is a P-h diagram of the cooling cycle of FIG. 1.

As illustrated in FIG. 2, the heat exchange unit 115 heats the outdoor air by exchanging heat with a refrigerant having risen to about 90° C. by compression of the refrigerant and the outdoor air, and lowers the temperature of the refrigerant. Unlike the air channel A1 passing through the condenser 111, the outdoor air thus heated is not discharged directly, but is used to regenerate the dehumidification rotor 121. That is, the heat exchange unit 115 is disposed before the dehumidification rotor 121 on the regeneration channel A12, and heats passing air to heat the dehumidification rotor 121 to a temperature required for regeneration. In this case, the heat exchange unit 115 may be configured as a separate configuration from the condenser 111, but may also be configured as a single device. In this case, the air channel A1 may be the regeneration channel A12.

The dehumidification rotor 121 is disposed between the regeneration channel A12 and the dehumidification channel A11 in the same manner as in the first and second embodiments. The regeneration channel A12 passes through the outdoor air inlet, the heat exchange unit 115, and the dehumidification rotor 121 and is discharged back outdoors, and the dehumidification channel A11 passes through the outdoor air inlet and the dehumidification rotor 121 and then is provided to a room.

In the case of the dehumidification rotor 121, since the temperature of the regeneration channel A12 rises to a relatively limited temperature compared to the first or second embodiment, as a dehumidifying agent coated on the dehumidification rotor 121, it is preferable to use a dehumidifying agent that may be regenerated at a relatively low temperature.

In this embodiment, since a heat source for regenerating the dehumidification rotor 121 does not have a separate heating source and utilizes the refrigerant compressed in the compressor 114, no additional energy is required and a cooling load to be cooled in the condenser 111 may be reduced, thereby improving the energy efficiency of the air conditioning system.

The air conditioning system may perform a ventilation-dehumidification-cooling mode performing cooling and dehumidification at the same time and a ventilation-dehumidification mode that dehumidifies and supplies outdoor air without cooling.

In addition, the dehumidification unit 103 may perform a ventilation mode when there is no dehumidification operation, and it is also possible to perform a ventilation-cooling mode in interlocking with the indoor unit 102. On the other hand, it is possible to perform an indoor dehumidification mode in which only the dehumidification of the indoor air is performed by circulating the indoor air to the dehumidification unit 103 while operating the dehumidification rotor 121 without the operation of the indoor unit 102.

In the case of the ventilation mode, the outdoor air is introduced into a room through the outdoor air inflow passage without the operation of the dehumidification rotor 121, and exhausted through an exhaust passage (e.g., duct 106 in FIG. 6) (not illustrated). The ventilation-cooling mode operates in the same way as the ventilation, but the cooling cycle 110 operates so that outdoor air that has passed through the dehumidification unit 103 joins the circulation channel A10 and is cooled while passing through the evaporator 113 and supplied to a room.

In the case of the indoor dehumidification mode, indoor air is supplied to the dehumidification rotor 121 through the indoor air inflow passage and then passes through the dehumidification rotor 121 to supply the dehumidified air back to a room and regenerate the dehumidification rotor 121 through the regeneration channel A12.

Figure 6:
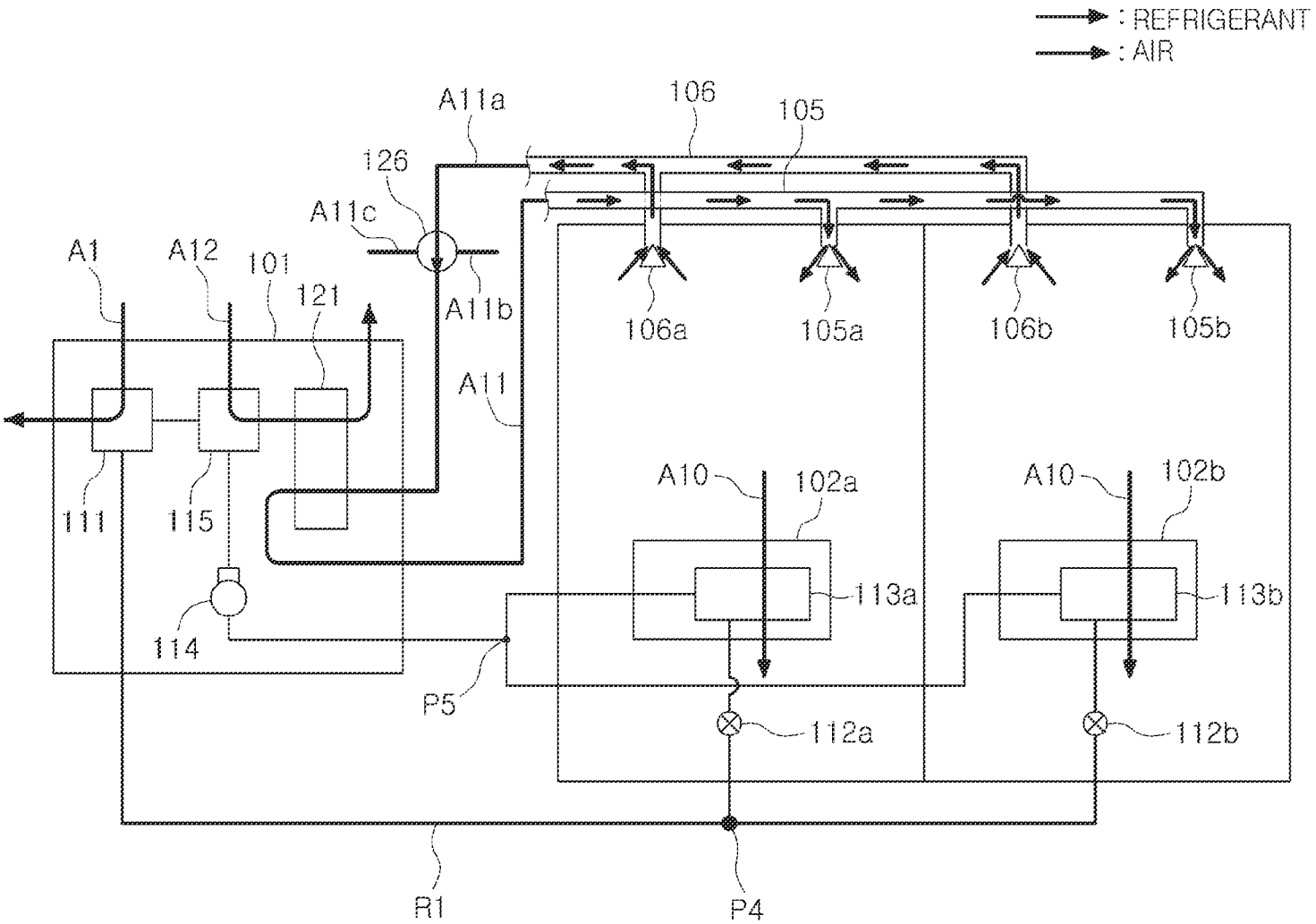
Figure 7:
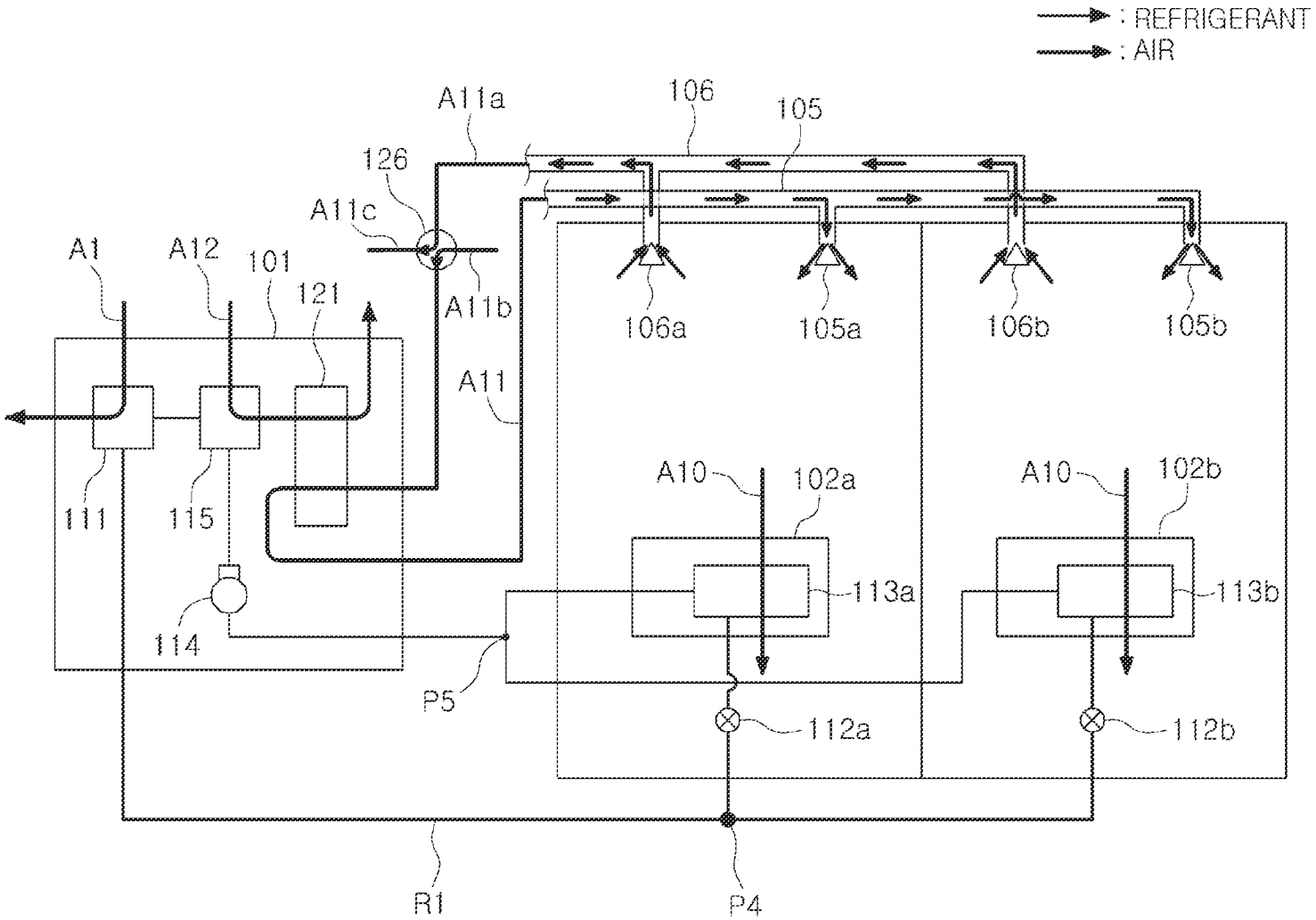
Figure 8:
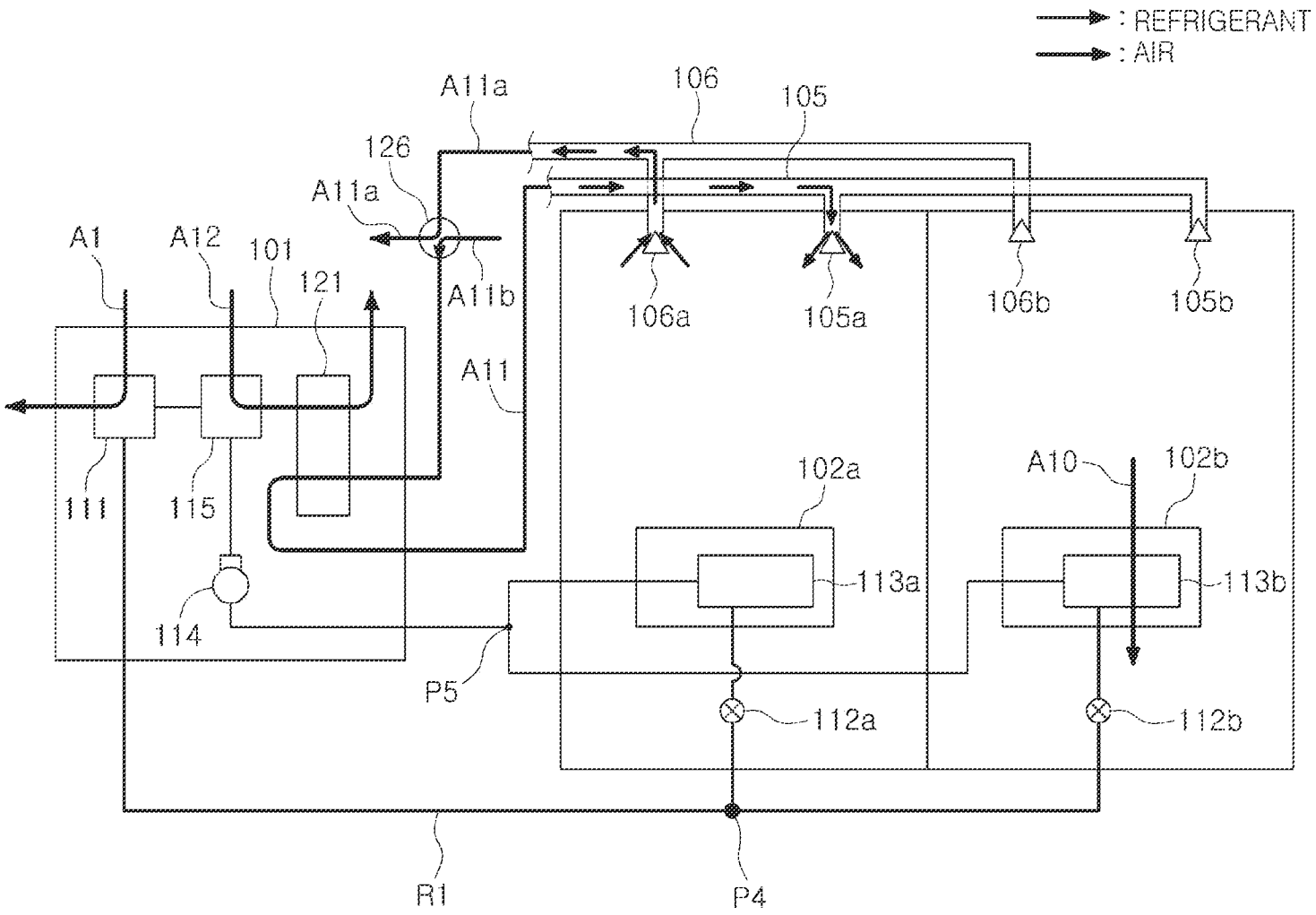

FIGS. 6 to 8 illustrate an air conditioning system according to a fourth embodiment of the present disclosure. Specifically, FIG. 6 illustrates a schematic diagram in which indoor dehumidification and cooling in the fourth embodiment of the present disclosure is performed, FIG. 7 illustrates a schematic diagram in which ventilation and dehumidification and cooling are performed, and FIG. 8 illustrates a schematic diagram in which dehumidification is performed in some spaces and cooling is performed in some spaces.

Similarly to the third embodiment, the fourth embodiment includes an outdoor unit 101 and an indoor unit 102, and a dehumidification rotor 121 is disposed inside the outdoor unit 101. Detailed descriptions of the same parts as those of the third embodiment will be omitted, and differences will be mainly described in the fourth embodiment.

In the case of the fourth embodiment, indoor units are respectively arranged in each space of a room. That is, the indoor unit includes a first indoor unit 102*a* and a second indoor unit 102*b*, and the cooling cycle 110 includes a refrigerant branch point P4 and a confluence point P5 in order for a refrigerant to be separately supplied and joined into the first and second indoor units 102*a* and 102*b*. To correspond to the first indoor unit 102*a* and the second indoor unit 102*b*, the evaporator 113 includes a first evaporator 113*a* and a second evaporator 113*b*, and the expansion valve 112 includes a first expansion valve 112*a* and a second expansion valve 112*b*, the number of which corresponds to the number of indoor units. Although only two spaces are illustrated in this embodiment, the number of spaces is not limited to two.

Indoor air inlets 106*a* and 106*b* and indoor supply units 105*a* and 105*b* are disposed in each space, and the indoor air inlets 106*a* and 106*b* and the indoor supply units 105*a* and 105*b* are respectively connected to the dehumidification rotor 121 of the outdoor unit 101, an outdoor air inflow passage A11*b* connected to the second outdoor air inlet, or an outdoor discharge passage A11*c* discharged to the outdoors through the ducts 105 and 106. The duct 105 is connected to the dehumidification channel A11, and the duct 106 is connected to a channel switching valve 126 which regulates the duct 106 to connect to either the outdoor discharge passage A11*c* or the dehumidification channel A11. The indoor air inlets 106*a* and 106*b* and the indoor supply units 105*a* and 105*b* are provided with dampers for allowing/blocking the inflow of air.

In the case of the fourth embodiment, the outdoor unit 101 performs condensation and dehumidification, the indoor unit 102 performs cooling, and the dehumidified air of the outdoor unit is configured to be supplied to a room. The dehumidified air may circulate indoor air, but outdoor air is dehumidified and supplied to a room, and it is determined whether to dehumidify indoor air or dehumidify and supply outdoor air by the operation of the channel switching valve 126.

An operation of the fourth embodiment will be described with reference to FIGS. 6 to 8.

FIG. 6 is a schematic diagram of a state in which indoor dehumidification and cooling are performed. Although not illustrated, the air conditioning system includes a control unit, which is connected to the indoor air inlets 106*a* and 106*b*, the indoor supply units 105*a* and 105*b*, the branch part P4, the compressor 114, the dehumidification rotor 121, and the channel switching valve 126. When the indoor dehumidification and cooling are performed in all spaces, all the indoor air inlets 106*a* and 106*b* and the indoor supply units 105*a* and 105*b* are opened by the operation of the control unit to allow the air flow, the compressor 114 operates to circulate a refrigerant in the refrigerant channel R1, the branch part P4 allows a refrigerant to be supplied to both the first and second evaporators 113*a* and 113*b*, the dehumidification rotor 121 rotates, and the channel switching valve 126 connects the indoor air inflow passage A11*a* to the dehumidification channel A11 to perform the indoor dehumidification mode.

In the fourth embodiment, in the case of the indoor dehumidification and cooling, the cooling is performed by the evaporators 113*a* and 113*b* of the indoor unit while the dehumidification is performed through the dehumidification rotor 121. Therefore, while humidity and temperature are each independently controlled, energy entering humidity and temperature only requires energy to the extent of entering cooling alone, and since many components may be omitted in the configuration, it is possible to reduce the size compared to the configuration of each device. In addition, since low-humidity indoor air is introduced into the evaporators 113*a* and 113*b*, condensation of moisture in the indoor air in the evaporators 113*a* and 113*b* may be reduced, and humidity-controlled air is provided to the evaporators 113 and 113*b* and thus drying may be quick or unnecessary, so the growth of mold or bacteria that may occur due to the moisture in the evaporators 113*a* and 113*b* may be reduced/prevented, thereby providing a user with healthy air.

FIG. 7 illustrates a schematic diagram of a state in which ventilation and dehumidification and cooling are performed.

When the ventilation and dehumidification mode and the cooling mode are performed in all spaces, all the indoor air inlets 106*a* and 106*b* and the indoor supply units 105*a* and 105*b* are opened by the operation of the control unit to allow the air flow, the compressor 114 operates to circulate a refrigerant to the refrigerant channel R1, the branch part P4 allows a refrigerant to be supplied to both the first and second evaporators 113*a* and 113*b*, the dehumidification rotor 121 rotates, and the channel switching valve 126 connects the indoor air inflow passage A11*a* to the outdoor discharge passage A11*c* and the outdoor air inflow passage A11*b* to the dehumidification channel A11 to perform the ventilation and dehumidification mode.

Therefore, the indoor air is cooled while passing through the first and second evaporators 113*a* and 113*b* along the circulation channel A10, and some of the indoor air is discharged to the outside through the indoor air inlets 106*a* and 106*b*, the channel switching valve 126, and the outdoor discharge passage A11*c*, and the outdoor air is supplied to a room in the dehumidified state through the outdoor air inflow passage A11*b*, the channel switching valve 126, the dehumidification rotor 121, the dehumidification channel A11, and the indoor supply units 105*a* and 105*b*. Accordingly, the ventilation, dehumidification, and cooling are performed simultaneously, and even if there is a high temperature and high humidity external environment, the dehumidified air is supplied while the cooling is performed in a room, so the ventilation may be performed without discomfort to a user. The indoor air inlets 106*a* and 106*b* and the indoor supply units 105*a* and 105*b* may be disposed on a ceiling. In this case, even if air having a relatively high temperature is introduced into a room through the indoor supply units 105*a* and 105*b*, the air comes into contact with a user after mixing with the existing cooled indoor air without coming into direct contact with the user due to the temperature difference from the indoor air, so the user may not feel the ventilation air.

FIG. 8 illustrates a schematic diagram of a fourth embodiment in which the dehumidification is performed in some spaces and the cooling is performed in some spaces. As illustrated in FIG. 8, in a state where the same operation is not performed in all spaces, the ventilation and dehumidification may be performed in some spaces and the cooling may be performed in some spaces. In FIG. 8, the space in which the first evaporator 113*a* is disposed is ventilated and dehumidified, and the space in which the second evaporator 113*b* is disposed is cooled.

In a first space (space in which the first evaporator is disposed) in which the ventilation and dehumidification is set by the operation of the control unit, the indoor air inlet 106*a* and the indoor supply unit 105*a* are opened to allow the air flow, but in a second space (space in which the second evaporator is disposed) in which only the cooling is set without setting the ventilation and dehumidification, the indoor air inlet 106*b* and the indoor supply unit 105*b* are closed. In this case, the closing of the indoor air inlet 106*b* and the indoor supply unit 105*b* is performed in a manner of blocking the dampers disposed in each supply unit/inlet part, and the ducts 105 and 106 branched to the corresponding supply unit/inlet part are provided with the dampers to block the indoor air inlet 106*b* and the indoor supply unit 105*b*. Meanwhile, the compressor 114 operates to circulate the refrigerant in the refrigerant channel R1, the branch part P4 allows a refrigerant to be supplied only to the second evaporator 113*b* that needs to operate among the first and second evaporators 113*a* and 113*b*, the dehumidification rotor 121 rotates, and the channel switching valve 126 connects the indoor air inflow passage A11*a* to the outdoor discharge passage A11*c* and the outdoor air inflow passage A11*b* to the dehumidification channel A11 so that the ventilation and dehumidification may be performed.

Accordingly, the indoor air is cooled while passing through the second evaporator 113*b* along the circulation channel A10 and cools the second space in which the second evaporator 113*b* is disposed. In this case, since the indoor air inlet 106*b* is closed, the indoor air of the second space does not escape to the outside and only the cooling is performed. Meanwhile, in the first space, a refrigerant is not introduced into the first evaporator 113*a*, so the first evaporator 113*a* does not operate and air does not flow into the circulation channel A10, and the indoor air is discharged to the outside through the indoor air inlet 106*a*, the channel switching valve 126, and the outdoor discharge passage A11*c*, and the outdoor air is supplied in the dehumidified state through the outdoor air inflow passage A11*b*, the channel switching valve 126, the dehumidification rotor 121, the dehumidification channel A11, and the indoor supply units 105*a* and 105*b*. Accordingly, the first space is ventilated and dehumidified. This control may be applied when there are two or more spaces, and each space may provide the desired air environment through the channel control.

In a residential space, there are spaces for specific purposes, for example, a dressing room, a drying room, and a bathroom, and these spaces need to be less cooled but may require ventilation and dehumidification. In this case, in the case of only the simple ventilation, outdoor air may be a problem in hot and humid summer. In the case of the fourth embodiment, the ventilated and dehumidified air may be provided to a specific space while cooling other spaces to satisfy the humidity/temperature of air required in the space.

Figure 9:
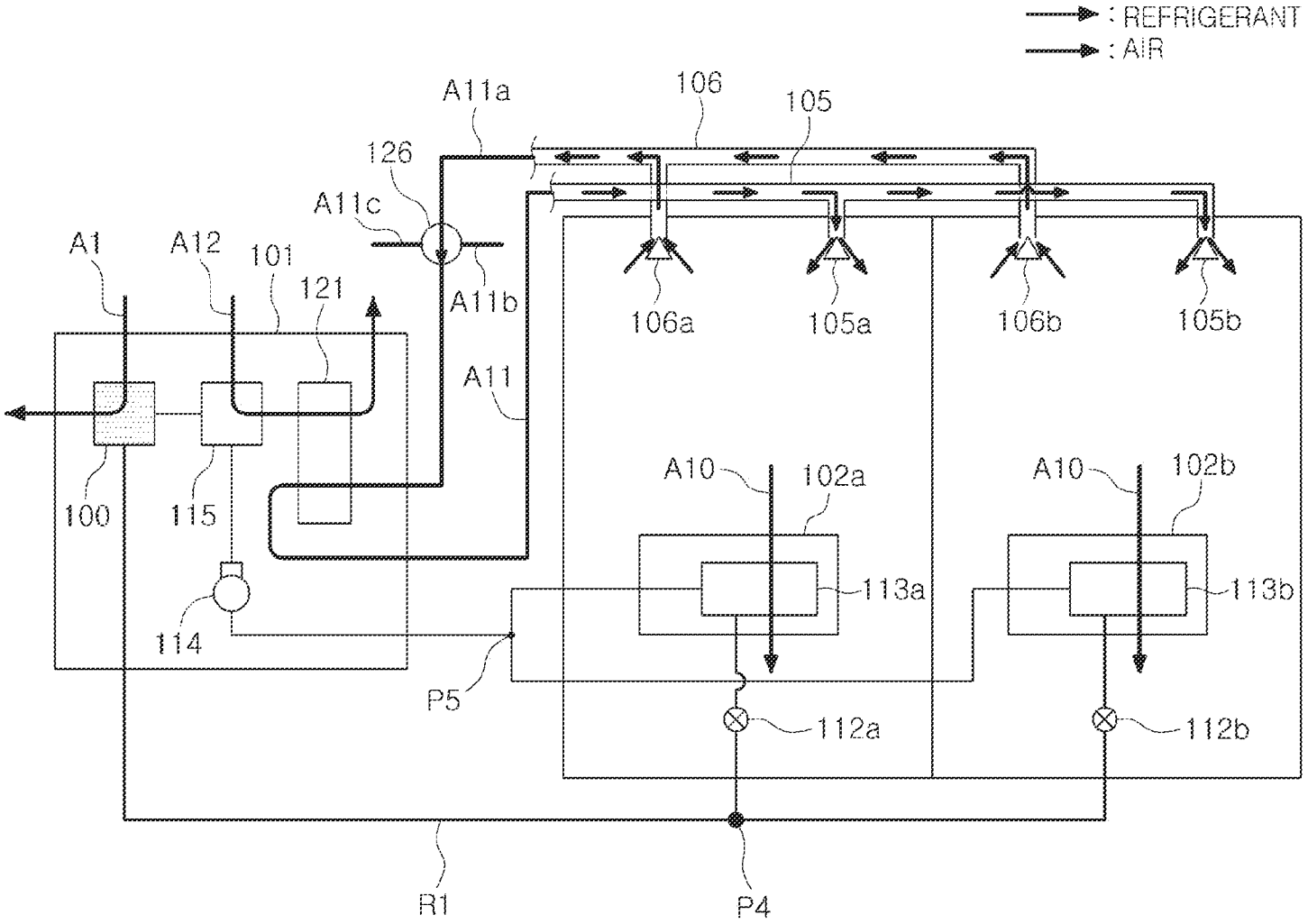
FIG. 9 is a schematic diagram of an air conditioning system according to a modified example of the fourth embodiment of the present disclosure.

FIG. 9 illustrates a schematic diagram of an air conditioning system according to a fifth embodiment of the present disclosure.

The fifth embodiment is different from the fourth embodiment in that, in the cooling cycle 110, the condenser is configured as an evaporative condenser 100. That is, similar to the fourth embodiment, the fifth embodiment includes an outdoor unit 101 and an indoor unit 102, a dehumidification rotor 121 is disposed inside the outdoor unit 101, indoor units are disposed in each space of a room, indoor air inlets 106*a* and 106*b* and indoor supply units 105*a* and 105*b* are disposed in each space of the room, the indoor air inlets 106*a* and 106*b* and the indoor supply units 105*a* and 105*b* are connected to the dehumidification rotor 121 of the outdoor unit 101, the outdoor air inflow passage A11*b* connected to the second outdoor air inlet, or the outdoor discharge passage A11*c* discharged outdoors through the ducts 105 and 106, respectively. The duct 105 is connected to the dehumidification channel A11, and the duct 106 is connected to a channel switching valve 126 which regulates the duct 106 to connect to either the outdoor discharge passage A11*c* or the dehumidification channel A11. The indoor air inlets 106*a* and 106*b* and the indoor supply units 105*a* and 105*b* are provided with dampers for allowing/blocking the inflow of air.

In the case of the fifth embodiment, latent heat of evaporation of water is utilized to condense a refrigerant passing through the heat exchange unit 115 through the evaporative condenser 100 to significantly lower the temperature of the refrigerant passing through the evaporative condenser 100 having a relatively small volume, thereby reducing the size of the overall system.

Since an embodiment of the evaporative condenser 100 has been described with reference to FIGS. 10 to 13, it will be described with reference to FIGS. 10 to 13.

Figure 10:
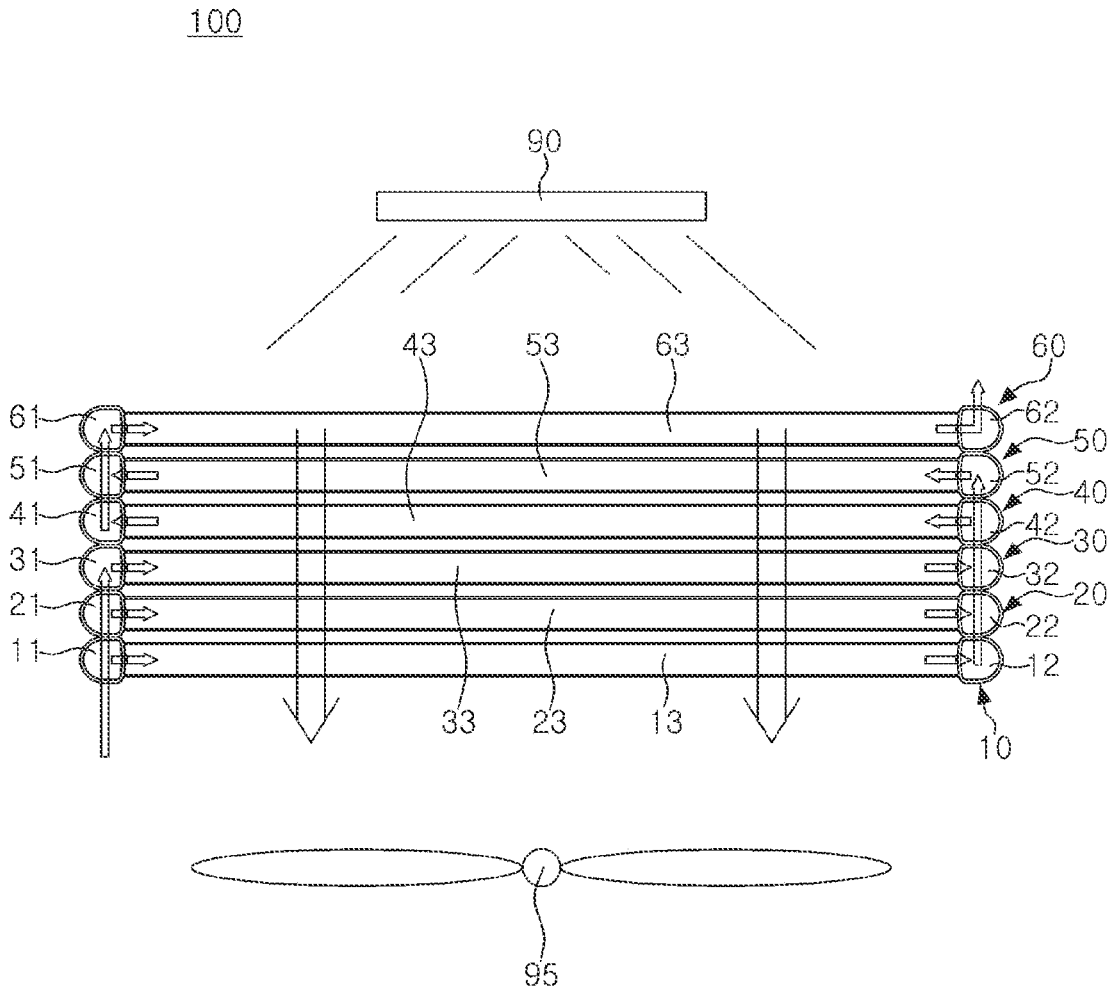
FIG. 10 is a schematic diagram of an evaporative condenser of FIG. 9.
Figure 11:
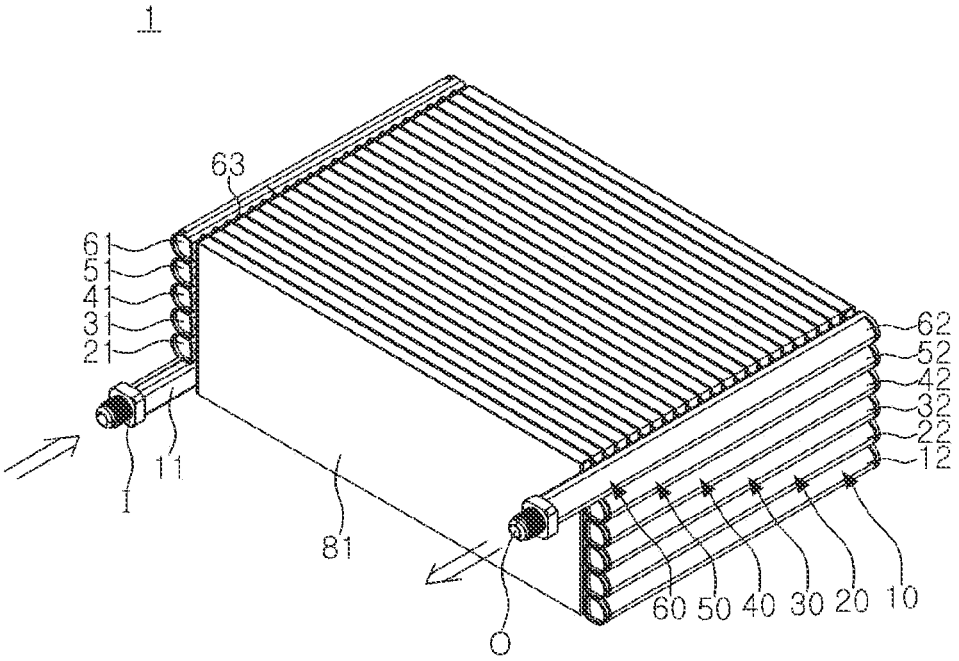
FIG. 11 is a schematic perspective view of a condensing module of FIG. 10.
Figure 12:
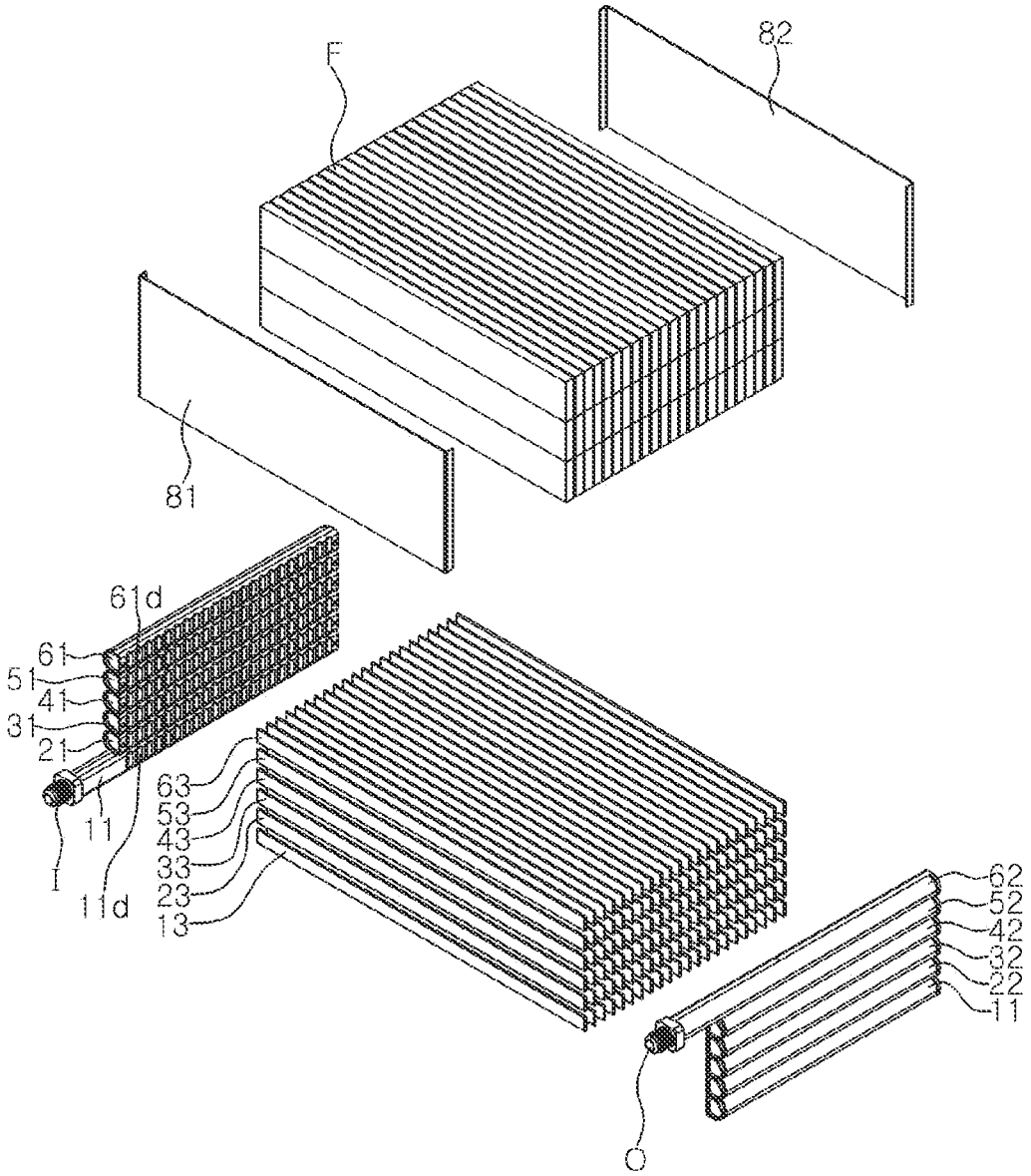
FIG. 12 is an exploded perspective view of a condensing module of FIG. 11.
Figure 13:
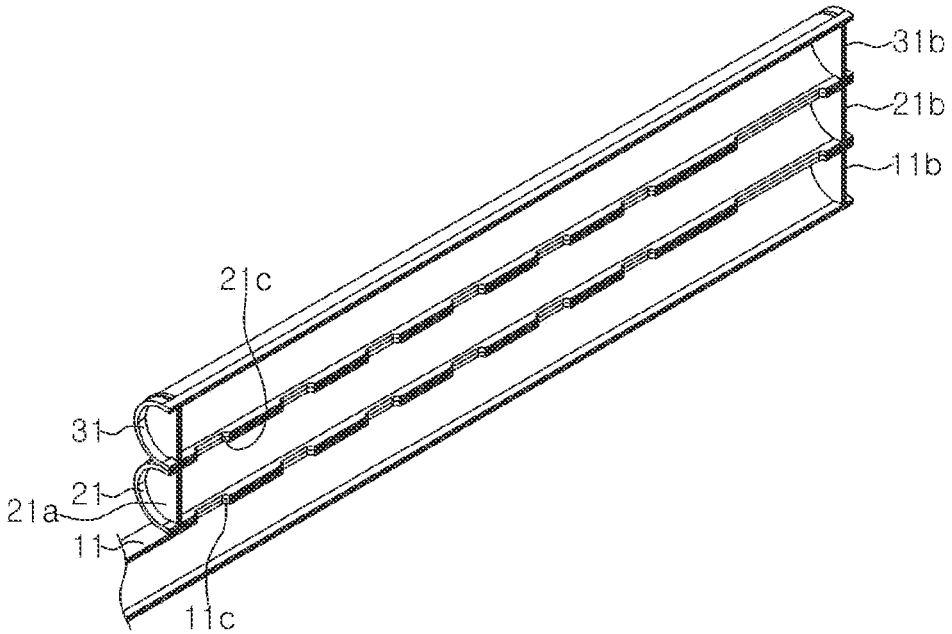
FIG. 13 is a cross-sectional perspective view of a first header of first to third header columns of the condensing module of FIG. 10.

The evaporative condenser 100 including the condensing module 1 is disclosed in FIGS. 10 to 13. Specifically, FIG. 10 illustrates a schematic diagram of the evaporative condenser 100 including the condensing module 1, FIG. 11 illustrates a schematic perspective view of the condensing module 1 of FIG. 10, FIG. 12 illustrates an exploded perspective view of the condensing module 1 of FIG. 11, and FIG. 13 illustrates a cross-sectional perspective view of first headers 11, 21, and 31 of first to third header columns 10, 20, and 30 of the condensing module 1 of FIG. 11.

As illustrated in FIGS. 10 to 13, the condensing module 1 in the evaporative condenser 100 includes first to sixth header columns 10, 20, 30, 40, 50, and 60, and the first header column is connected to a fluid inlet I, the sixth header column 60 is connected to a fluid outlet O, covers 81 and 82 are disposed on both front and rear sides of connection tubes 13, 23, 33, 43, 53, and 63 of the first to sixth header columns 10, 20, 30, 40, 50, and 60, and a fin member F to help heat exchange is disposed between each connection tube 13, 23, 33, 43, 53, and 63.

In addition, a water injection module 90 for spraying water is disposed in an upper portion of the condensing module 1, and a blower 95 for flowing air between the connection tubes 13, 23, 33, 43, 53, and 63 is disposed on a lower portion of the condensing module 1.

In the condensing module 1, the fluid (refrigerant) is introduced into the first header column 10 at the lower portion, and exits into the sixth header column 60 at the upper portion. Water is sprayed from top to bottom through the water injection module 90. The air passes through the connection tubes 13, 23, 33, 43, 53, and 63 together with water while being sucked in from the top to the bottom by the blower 95 disposed at the lower portion. Water is evaporated while passing between the connection tubes 13, 23, 33, 43, 53, and 63, and heat exchange occurs between fluid and water/air by the latent heat of evaporation and the sensible heat of water/air, so the fluid passing through the condensing module 1 is condensed. In this case, a heat exchange area may increase by the fin member F disposed between the connection tubes 13, 23, 33, 43, 53 and 63.

In this embodiment, the heat exchange between the water/air and fluid (refrigerant) occurs, and the heat exchange occurs in counter-flow to each other. That is, since the heat exchange occurs as the water and air flow from top to bottom and the fluid flows from bottom to top, it is possible to further lower the temperature of the final fluid compared to non-counter-flow. In particular, although described below, it is possible to improve the cooling efficiency in the structure of this embodiment. Through this structure and the counter-flow configuration, it is possible to lower the final fluid temperature while maintaining the size of the condensing module 1.

Meanwhile, this embodiment has been described in a manner that air is sucked from the top to the bottom by the blower 95, but is not limited thereto, and the blower 95 is installed in the upper portion, and may operate in a manner that pushes the air from top to bottom.

Furthermore, it is also possible for air itself to flow from bottom to top.

The condensing module 1 of the present disclosure has a three-dimensional structure because the fluid passes in a first direction which is an extension direction of the header, a second direction which is an extension direction of the connection tube, and a third direction which is a stacking direction of the header column, so even if the condensing module 1 occupies the same volume, more heat exchange is possible, thereby improving cooling performance. In this case, the first direction, the second direction, and the third direction may be different directions.

For example, the first direction may be an X direction, the second direction may be a Y direction perpendicular to the X direction, and the third direction may be a Z direction perpendicular to the X direction and the Y direction, otherwise the first direction may be a radial direction, the second direction may be a circumferential direction, and the third direction may be a height direction.

In the present disclosure, a process in which a fluid enters from the fluid inlet, flows in along the first headers 11, 21, 31, 41, 51, and 61, passes through the connection tubes 13, 23, 33, 43, 53, and 63, and then goes to the second headers 12, 22, 32, 42, 52, and 62, and passes through the connection tubes 13, 23, 33, 43, 53, and 63 from the second headers 12, 22, 32, 42, 52, and 62 after moving in the third direction from second headers 12, 22, 32, 42, 52, and 62 and goes to the first headers 11, 21, 31, 41, 51, and 61, which is repeated. That is, the fluid flows in the second header direction from the first header, and then flows in the first header direction from the second header while changing the direction in the second direction, and when changing the direction, the cross-sectional area through which the fluid passes may be reduced. In the second direction, the direction from the first header 11, 21, 31, 41, 51, and 61 toward the second header 12, 22, 32, 42, 52, and 62 is referred to as a 2-1 direction, and the direction from the second headers 12, 22, 32, 42, 52, and 62 toward the first headers 11, 21, 31, 41, 51, and 61 is referred to as a 2-2 direction.

Meanwhile, the first to sixth head columns 10, 20, 30, 40, 50, and 60 of the present disclosure includes the first headers 11, 21, 31, 41, 51, and 61 that are disposed on one side and have a channel formed therein, the second headers 12, 22, 32, 42, 52, and 62 that are disposed on the other side and have a channel formed therein, and the plurality of connection tubes 13, 23, 33, 43, 53, and 63 that connect the channels of the first headers 11, 21, 31, 41, 51, and 61 and the second headers 12, 22, 32, 42, 52, and 62 between the first headers 11, 21, 31, 41, 51, and 61 and the second headers 12, 22, 32, 42, 52, and 62.

In the case of the first header 11 of the first header column 10, one side is connected to the fluid inlet I along a longitudinal direction, and the other side has a tubular shape blocked by a baffle 11*b*. In the case of the first header 11 of the first header column 10, a channel hole 11*c* is formed at the upper portion, and a channel hole 21*c* is also formed under the first header 21 of the second header column 10 at a position corresponding to the channel hole 11*c* of the first header column 10, so the first header 11 of the first header column 10 and the first header 21 of the second header column 20 communicate with each other. Furthermore, in the case of the first header 21 of the second header column 20, the channel hole 21*c* is provided not only on the lower portion but also on the upper portion facing the first header 31 of the third header column 30, and a channel hole 31*c* is also formed in the first header 31 of the third header column 30 at a position corresponding to the channel hole 21*c*, so the fluid introduced into the first header 11 of the first header column 10 moves to the first header 21 of the second header column 20 and the first header 31 of the third header column 30.

In the case of the first header 21 of the second header column 20, both sides in the longitudinal direction are blocked by baffles 21*a* and 21*b*, and the same goes for the case with the first header 31 of the third header column 30.

Meanwhile, in the case of the first headers 11, 21, 31, 41, 51, and 61, communication holes 11*d* and 61*d* for communicating with the connection tubes 13, 23, 33, 43, 53, and 63 are formed on the surface facing the second header 12, 22, 32, 42, 52, and 62 and the plurality of connection tubes 13, 23, 33, 43, 53, and 63 are connected between the first headers 11, 21, 31, 41, 51, and 61 and the second headers 12, 22, 32, 42, 52, and 62, so the plurality of communication holes 11*d* and 61*d* are formed.

In the case of the second headers 12, 22, 32, 42, 52, and 62, the same structure as that of the first headers 11, 21, 31, 41, 51, and 61 is symmetrically formed. The connection tubes 13, 23, 33, 43, 53, and 63 have a structure in which a plurality of micro-channels, i.e., fine-channels are formed in the longitudinal direction of the tube. The fin member F is connected between the connection tubes 13, 23, 33, 43, 53, and 63 to expand the heat exchange area. The connection tubes 13, 23, 33, 43, 53, and 63 and the first and second headers 11, 12, 21, 22, 31, 32, 41, 42, 51, 52, 61, and 62 may be coated with Tech Arc Coating (TAC).

The pin member (F) is coated with a porous material containing hydrophilicity in order to evenly spread the water sprayed by the water injection module 90. The porous material is coated with a metal organic framework (MOF).

The flow of fluid in an evaporative cooling device including the condensing module 1 will be described.

In one embodiment of the present disclosure, the fluid introduced into the first header 11 of the first header column 10 is divided into the first header 21 of the second header column 20 and the first header 31 of the third header column 30, flows along the connection tubes 13, 23, 33 from the first headers 11, 21, and 31 of the first to third header columns 10, 20, and 30 to the second headers 12, 22, and 32, and is exchanged with heat by water/air during the flowing to partially change from gas to liquid, thereby reducing the volume occupied by the fluid having the same weight.

The second headers 12, 22, and 32 of the first to third header columns 10, 20, and 30 are connected to the second headers 42 and 52 of the fourth and fifth header columns 40 and 50 through the channel hole, so the fluid introduced into the second headers 12, 22, 32 of the first to third header columns 10, 20, and 30 rises back to the second headers 42 and 52 of the fourth and fifth header columns 40 and 50. Thereafter, the fluid flows along the connection tubes 43 and 53 from the second headers 42 and 52 of the fourth and fifth header columns 40 and 50 to the first headers 41 and 51, and is exchanged with heat by water/air while passing through the connection tubes 43 and 53 to partially change from gas to liquid, so reducing the volume occupied by the fluid having the same weight again.

The fluid introduced into the first headers 41 and 51 of the fourth and fifth header columns 40 and 50 rises to the first header 61 of the sixth header by the channel hole formed between the fourth to sixth header columns 40, 50, and 60. The raised fluid moves from the first header 61 to the second header 62 of the sixth header column 60 through the connection tube 63, and is condensed into a liquid by exchanging heat with water/air while moving through the connection tube 63. The second header 62 of the sixth header column 60 is connected to the fluid outlet O, and the fluid condensed while passing through the first to sixth header columns 10, 20, 30, 40, 50, and 60 is discharged through the fluid outlet O and delivered to another configuration of the cooling cycle.

In the case of the condensing module 1 according to the embodiment of the present disclosure, the fluid is introduced into the first header 11, and then flows in the 2-1 direction facing the second headers 12, 22, 32, 42, 52, and 62 from the first headers 11, 21, 31, 41, 51, and 61, and flows in the 2-2 direction facing the first headers 11, 21, 31, 41, 51, and 61 from the second headers 12, 22, 32, 42, 52, and 62 by switching the direction, flows in the 2-1 direction by switching the direction again and then is discharged to the fluid outlet O, and the number of header columns through which the fluid passes changes when switched to the 2-1 direction→2-2 direction→2-1 direction. That is, the number of header columns flowing in the 2-1 direction after the fluid is introduced is three as the first to third header columns 10, 20, and 30, and after the direction is switched to the 2-2 direction, the number of fourth and fifth header columns 40 and 50 is reduced to two, and after the direction switches to the 2-1 direction again, the number of sixth header column 60 is reduced to one, so the number of header columns through which the fluid passes as a whole is reduced to 3→2→1.

In one embodiment of the present disclosure, since the header columns are stacked and formed in the same size, as the number of header columns increases, the area through which the fluid passes increases, which means that the occupied volume increases, and as the number of header columns decreases, the area through which the fluid passes decreases, which means the occupied volume decreases.

Therefore, at the fluid inlet I, where the gas state is mostly in the initial stage, the fluid passing in the 2-1 direction is cooled while simultaneously passing through three header columns, that is, the connection tubes 13, 23, and 33 of the first to third header columns 10, 20, and 30. The heat exchange is performed going backwards, and thus, as the liquid state increases, the fluid passes through a small number of header columns, and finally passes through only the connection tube 63 of one header column 60. Therefore, it is possible to reduce the cross-sectional area of the channel of the condenser 1 through which the fluid passes according to the decrease in the volume of the fluid, thereby reducing the pressure loss caused by the decrease in the volume.

The reduced pressure loss means that a lot of heat exchange may be made during the time the fluid (refrigerant) passes. Even with the same size condenser, since a large amount of heat exchange is possible, when the capacity is the same, the condenser may be used with a smaller size, and when the size is the same, the large-capacity cooling is possible.

In addition, the condenser 1 of the present disclosure has the three-dimensional structure because the fluid passes in the first direction which is the extension direction of the header, the second direction which is the extension direction of the connection tube, and the third direction which is the stacking direction of the header column, so even if the condenser 1 occupies the same volume, more heat exchange is possible, thereby improving the cooling performance. For example, the first direction may be the X direction, the second direction may be the Y direction perpendicular to the X direction, and the third direction may be the Z direction perpendicular to the X direction and the Y direction.

The present disclosure may provide an air conditioning system that facilitates humidity control and cooling control of indoor air through the above configuration.

An embodiment of the present disclosure may provide an air conditioning system in which the provision of additional energy for regeneration of a dehumidification rotor is saved while lowering a condensing load in cooling.

Although the embodiments of the present disclosure have been described above, it goes without saying that the present disclosure is not limited thereto and may be implemented with various modifications.

What is claimed is:

1. An air conditioning system, comprising:

a compressor, a condenser, an expansion valve, and an evaporator through which a refrigerant circulates;

an indoor unit in which the evaporator is disposed;

an outdoor unit in which the condenser is disposed; and a dehumidification unit connected to the indoor unit, wherein the dehumidification unit includes a regeneration channel including a first outdoor air inlet and an outdoor outlet, a dehumidification channel including an indoor supply and at least one of an indoor air inlet and a second outdoor air inlet, a dehumidification rotor disposed between the regeneration channel and the dehumidification channel, and a heat exchange unit disposed between the dehumidification rotor and the first outdoor air inlet in the regeneration channel to heat passing air, wherein the indoor unit is configured such that the air supplied from the indoor supply passes through the evaporator and then is supplied to a room, wherein the condenser is an evaporative condenser, wherein the evaporative condenser includes:

a condensing module including a fluid passage;

a water injection module spraying water passing through the condensing module from an upper portion of the condensing module; and a blowing module disposed on one side of the condensing module to provide air passing through the condensing module, wherein, in the condensing module, a plurality of header columns, each including a first header extending in a first direction with a channel formed therein, a second header extending in the first direction with a channel formed therein, and a plurality of connection tubes extending in a second direction between the first header and the second header while connecting the respective channels, are stacked in a third direction, wherein the first to third directions are different from each other, and wherein the condensing module, the water injection module, and the blowing module are disposed such that the water sprayed by the water injection module and the air provided by the blowing module pass between the connection tubes of the condensing module.

2. The air conditioning system of claim 1, wherein the heat exchange unit is configured to exchange heat between the refrigerant between the condenser and the compressor and the air introduced from the first outdoor air inlet.

3. The air conditioning system of claim 1, wherein the dehumidification channel is connected to an air duct disposed in the room.

4. The air conditioning system of claim 1, wherein the dehumidification channel includes a valve allowing air flow to only one of the indoor air inlet and the second outdoor air inlet.

5. The air conditioning system of claim 1, wherein the regeneration channel is connected to the indoor air inlet, and the system comprises a ventilation and dehumidification mode in which indoor air is introduced into the regeneration channel, while outdoor air is introduced into the dehumidification channel, and an indoor dehumidification mode in which the outdoor air is introduced into the regeneration channel and the outdoor air is introduced into the dehumidification channel.

6. The air conditioning system of claim 1, wherein a valve adjusts connections with the dehumidification channel toward the dehumidification rotor, an indoor air inflow passage connected to the indoor air inlet, an outdoor air inflow passage connected to the second outdoor air inlet, and an outdoor discharge passage connected to an outside, and when an indoor dehumidification mode is performed, the dehumidification channel and the indoor air inflow passage are connected, and when a ventilation and dehumidification mode is performed, the dehumidification channel and the outdoor air inflow passage are connected.

7. An air conditioning system, comprising:

a compressor, a condenser, an expansion valve, and an evaporator through which a refrigerant circulates;

an indoor unit in which the evaporator is disposed;

an outdoor unit in which the condenser is disposed; and a dehumidification unit connected to a room, wherein the dehumidification unit includes a regeneration channel including a first outdoor air inlet and an outdoor outlet, a dehumidification channel including an indoor supply unit and at least one of an indoor air inlet and a second outdoor air inlet, a dehumidification rotor disposed between the regeneration channel and the regeneration channel, and a heat exchange unit disposed between the dehumidification rotor and the first outdoor air inlet in the regeneration channel to heat passing air, and the heat exchange unit is configured to exchange heat between the refrigerant between the condenser and the compressor and the air introduced from the first outdoor air inlet.

8. The air conditioning system of claim 7, wherein the dehumidification channel is connected to the evaporator disposed in the indoor unit.

9. The air conditioning system of claim 7, wherein the dehumidification rotor is disposed in the outdoor unit, in the dehumidification channel, the indoor air inlet and the indoor supply are connected through a duct, and a valve for adjusting only air of either the indoor air inlet or the second outdoor air inlet to flow into the dehumidification rotor is disposed before the dehumidification rotor on the dehumidification channel.

10. The air conditioning system of claim 9, wherein a plurality of indoor air inlets and indoor supply units are provided in a room, the duct is provided with a damper for allowing or blocking air flow, and the air conditioning system further includes a plurality of fans generating an air flow including the dehumidification channel and the regeneration channel; and a control unit connected to the damper, the compressor, and the plurality of fans.

* * * * *